United States Patent [19]

Josefsson

[11] 4,422,464

[45] Dec. 27, 1983

[54] APPARATUS FOR THE FORMING OF HAIR

[75] Inventor: Bertil Josefsson, Kågeröd, Sweden

[73] Assignee: NPI New Products Investment AB, Askim, Sweden

[21] Appl. No.: 248,569

[22] PCT Filed: Jul. 30, 1980

[86] PCT No.: PCT/SE80/00196

§ 371 Date: Mar. 27, 1981

§ 102(e) Date: Mar. 27, 1981

[87] PCT Pub. No.: WO81/00347

PCT Pub. Date: Feb. 19, 1981

[30] Foreign Application Priority Data

Jul. 30, 1979 [SE] Sweden ..... 7906447

[51] Int. Cl.[3] ..... A45D 20/00

[52] U.S. Cl. ..... 132/9; 34/78

[58] Field of Search ..... 132/9, 33 R, 37 R; 219/222; 34/78

[56] References Cited

U.S. PATENT DOCUMENTS 3,102,941 9/1963 Pope ..... 132/37 R
3,107,675 10/1963 Embiricos ..... 132/33 R
3,173,428 3/1965 Postel ..... 132/9
3,182,666 5/1965 Watkins ..... 132/9

*Primary Examiner*—Gregory E. McNeill

[57] ABSTRACT

Method and apparatus for the forming of hair. At the forming a strand of hair is drawn into a chamber (24) from an orifice (29) thereof by means of an air stream flowing inwards from said orifice. The chamber is shaped to produce an intended curvature of the strand of hair. By means of introduction of heated air through openings (28) close to the orifice (29) of the duct, the horny substances of the hair will be softened so that a plastic bend of the hair is obtained. The strand of hair being subjected to heating during a predetermined period of time, which is adjusted to the softening process of the horny substance and carried out by a heating means (19) for the supplied air by means of an automatic time controlling device (64) being maintained in activated condition. After said period of time the heating means (19) is inactivated so that the air streaming through the openings (28) at least acquires the ambient temperature, the hair curl being retained in the chamber during a second predetermined period of time, which is adjusted for cooling off the hair, so that the horny substance again solidifies and fixes the hair in the form produced by the chamber (24).

5 Claims, 9 Drawing Figures

APPARATUS FOR THE FORMING OF HAIR

TECHNICAL FIELD

The present invention relates to a method and apparatus for forming of hair. More specifically the invention relates to an apparatus in which a hair forming tool is communicating with one duct for the exhaust of air and one duct for the supply of air enclosing a heating means, whereby the tool is provided in such a manner that a strand of hair can be introduced into the same to be in contact with a stream of heated air, which flows from the air supply duct and to the duct for the exhaust of the air. The hair can hereby be formed by means of the heated air.

BACKGROUND

It is prior known, see SE-PS No. 364 432, BE-PS No. 621 488 and U.S. Pat. No. 3,107,675 to manufacture apparatuses for hair forming and drying comprising a spiral or otherwise curved chamber exhibiting an open orifice and in addition, located close to said orifice, an inlet from a first conduit, while the inner end of the chamber is connected to a second conduit. The first conduit starts from a chamber housing a heat generating element. The second conduit is connected with the suction side of a fan. Thus, hot air from the inlet at the orifice flows through the chamber in direction towards the second conduit, through which it is evacuated by means of said fan.

If a strand of hair is introduced through the open orifice, it will be carried along by the air stream and will be introduced into the chamber. The hair strand is heated by the hot air and takes the shape of the chamber by softening of the horny substance of the hair, which shape will be fixed if the hair is extracted and permitted to cool down in the acquired shape. The effect can be increased by using suitable liquids or by carrying out the forming operation while the hair is still wet after a wash. The acquired form can of course also be modified by means of combing after extraction from the chamber. Thus, an apparatus of this kind makes possible the forming of the hair in a simple manner, which moreover can be combined with drying.

TECHNICAL PROBLEM

However, it has turned out that these known apparatuses are not capable to bring about a durable formation of the hair. This is an especially great drawback in connection with apparatuses of the kind in question, as it is not possible to produce a pronounced curling of the hair. Thus, the relatively soft curl would require a great durability, as it does not permit any significant straightening out in order not to loose its curled form. As a result of these facts apparatuses of the kind mentioned have not found any widespread application.

THE SOLUTION

The invention solves said problem by means of a method, in which an apparatus of the kind mentioned is employed and by means of a modification of this type of apparatus. The invention means that the hair is treated in a carefully prepared sequence of operations, which in addition to heating also comprises cooling off of the curl formed.

ADVANTAGES

By means of the method and the apparatus respectively according to the invention a hair styling is obtained, which is much more durable than what has hitherto been possible with apparatuses of the kind in question. This is obtained without making the operation more complicated for the person who shall carry out the operation.

BRIEF DESCRIPTION OF DRAWINGS

Two embodiments of the invention are illustrated in the accompanying drawings, four variants being shown of one detail.

BEST MODE OF CARRYING OUT THE INVENTION

Figure 1:
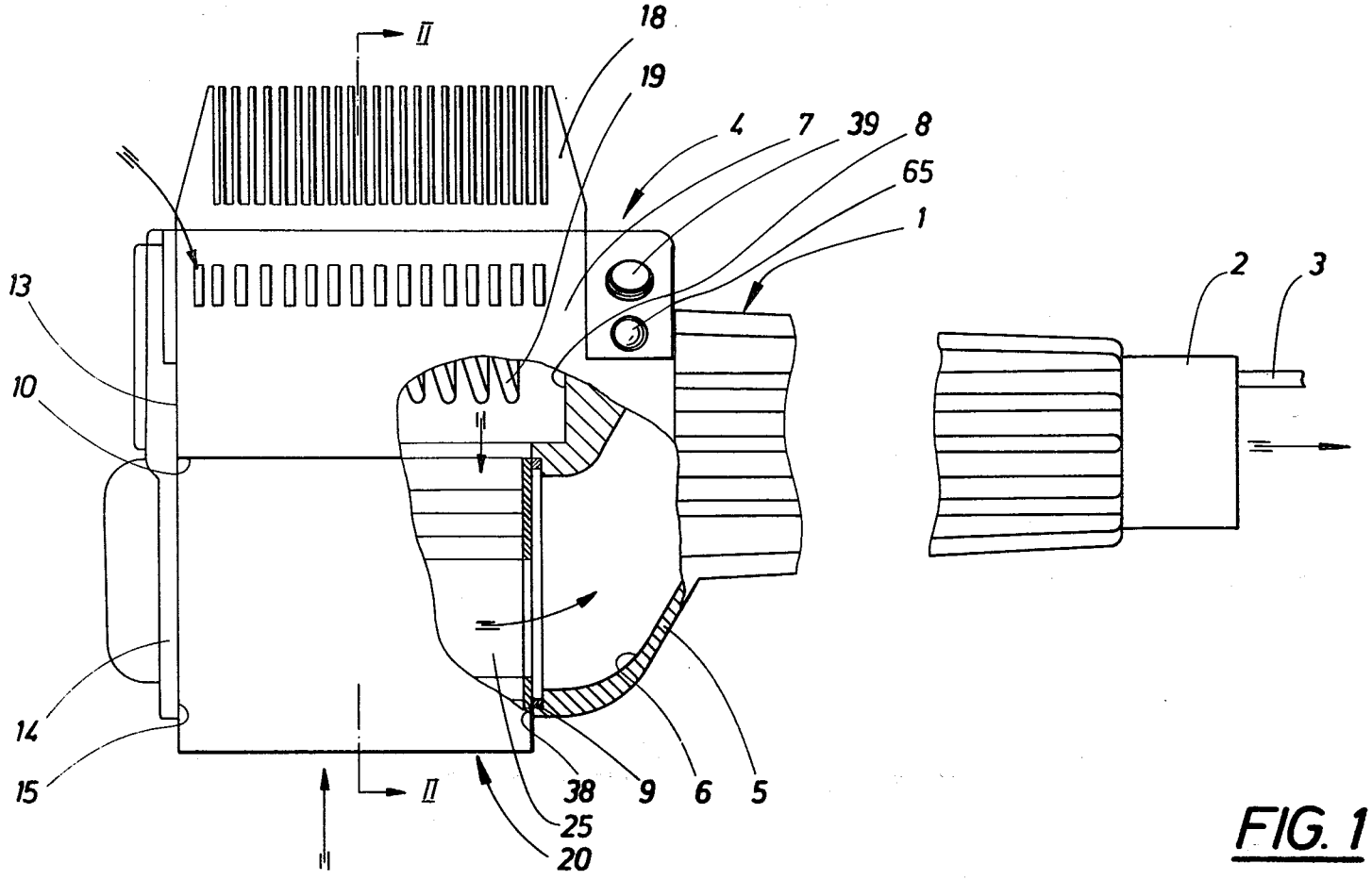
FIG. 1 is a side elevational view of the apparatus according to the first embodiment.

According to FIG. 1 the apparatus according to the first embodiment has a handle 1, which because of considerations of space in the drawings is shown broken and shortened. A duct extends through said handle, showing an orifice ending with a socket 2. An electric cable 3 extends in the duct. The handle 1 at the end thereof opposing the socket 2 supports a casing 4 with a first portion 5 having a duct 6, which is a direct continuation of said duct through the handle 1. The casing 4 moreover has a second portion 7 with an inner chamber 8. The portion 5 has a straight front wall 38, in which the duct 6 has an orifice with a gasket 9. The portion 7 at right angle to the front wall 38 has a front wall 10, which by means of a duct 11 communicates with the chamber 8. Grooves 12 are made in the duct 11 and extend unto the front wall 38 being open towards the end 13 of the casing 4, which occupies a position opposite the handle 1. The end wall 13 supports a flap 14, which is pivotable on a shaft (not shown), which forms a right angle to the end wall 13 and is level to the center of the chamber 8. The flap 14 has a front end 15, the surface of which is in line with the end wall 13 and opposes the front surface 38, when the flap occupies the position illustrated in FIG. 1. However, it can be pivoted round the shaft mentioned, so that it will be outside of the area in the front of the groove 12 as counted from the chamber 8.

By means of openings 16 in the casing portion 7 the chamber 8 is in communication with the surrounding air. The one side of the casing portion 7, which opposes the side where the front wall 10 is located, is provided with a groove 17 intended to permit the attachment of accessories, which are useful in connection with the hairdressing work, as is shown in the form of a comb 18.

An electric heating element 19 is mounted inside the chamber 8. The heating element 19 is connected with the cable 3, which in its turn is intended to be in connection with an electric power supply. A switch 39 is provided for the start of the heating by the electric heating element.

The forming chamber mentioned is housed in a casing 20 with an outer wall 21, and said casing can be attached to the casing 4 by means of profiles 22, formed by the outer wall 21, which profiles can be inserted into the groove 12, if the flap 14 has been folded aside previously. After the flap 14 has been swung down into the position illustrated in FIG. 1, the casing 20 is held with pressure against the front wall 38, the tightening to the duct 6 being provided by means of the gasket 9.

By means of a wall 23 two chambers are formed in the casing 20 inside the outer wall 21, one inner spiral shaped chamber 24 terminating in a chamber 25, and one outer chamber 26, which by means of an opening 27 fits to the flange formed by the profiles 22. The chamber 26, which is divided up into two portions, one on each side of the outer end of the chamber 24, is in communication with the chamber 24 via narrow openings 28. Said openings surround an entrance 29, which communicates the chamber 24 with the surrounding air.

Figure 2:
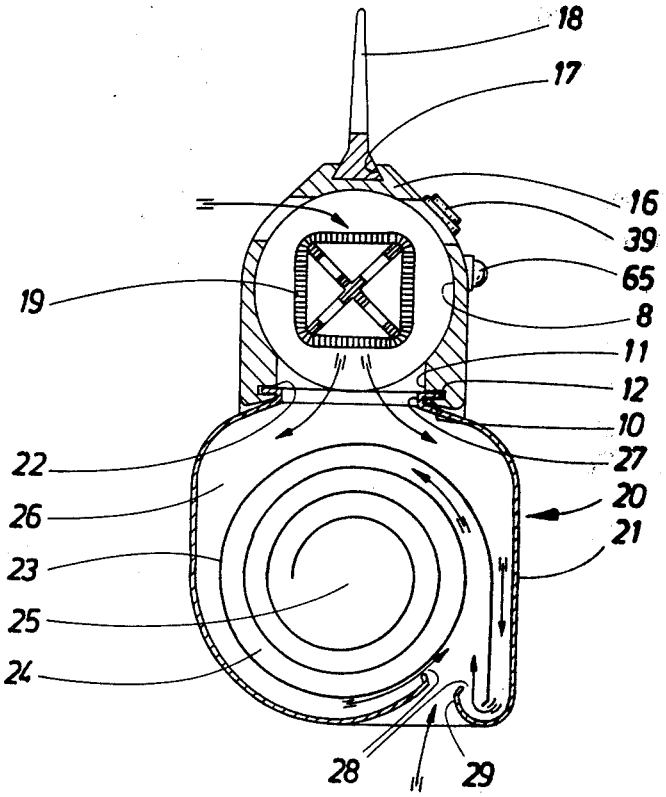
FIG. 2 is a cross-sectional view of the apparatus along the line II—II in FIG. 1 with the detail viz. the forming chamber, in its first variant.
Figure 3:
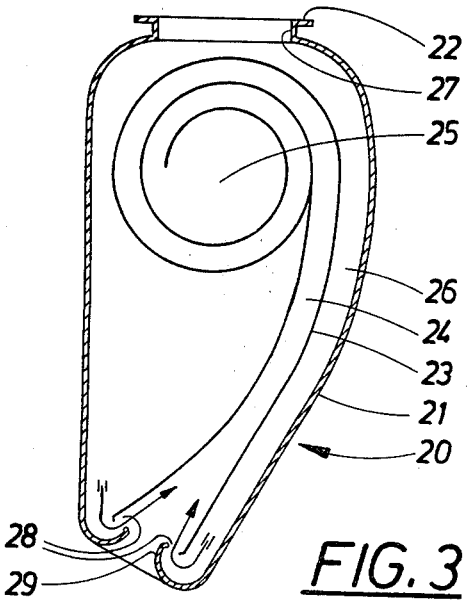
FIG. 3 is a cross-sectional view corresponding to the cross-section illustrated in FIG. 2 and showing the forming chamber in a second variant.

The casing 20 has lateral walls, which extend in plane, which is equivalent to the plane of the paper as seen in FIG. 3. These outer walls are provided with holes right in front of the central chamber 25. When the casing 20 is in the position shown in FIG. 2, one of these holes occupies a position right in front of the duct 6, whereas the other one is covered by the flap 14. This means that the chamber 25 is in communication with the duct 26 and consequently via the handle 1 with the connecting socket 2, while the chamber 26 via the opening 27 is in communication with the chamber 8 and consequently with the surrounding air through the openings 16.

A fan device also belongs to the apparatus and is arranged to create an underpressure in a hose conduit, which is intended to be connected with the connecting socket 2. The cable 3 extends through this conduit and at the fan device it is connected to the electric power supply. The fan device may be designed more or less as a vacuum cleaner. However, the air drawn in must not be conveyed through the electric driving motor, as is a common feature in vacuum cleaners, as this air is heated up, which will be described later on.

When starting the fan device in question, air will be sucked through the duct and, thus, an underpressure will be created in the duct 6 and consequently also in the chamber 25. This underpressure creates an inward flowing air stream in the duct 24, which means that air is rushing in through the entrance opening 29 from the surrounding air at the same time as air is drawn along through the narrow openings 28 from the two portions of the chamber 26. The air rushing in through the openings 28 must be supplied through the opening 27 and because of this it flows through the chamber 8, into which it flows from the surrounding air through the openings 16. When doing this, it passes the electric heating element 19, which is assumed to be switched on. The air rushing through the chamber 24 and into the chamber 25 thus consists for one part of air from the outside through the entrance opening 29 and for another part of heated-up air through the openings 28. In this manner a mixing temperature is obtained in the chamber 24, the temperature of which can be regulated by the capacity of the heating element 19, the through flow capacity of the fan and the relative proportion between the openings 28 and 29, as well as the prevailing resistance of flow. If the heating element is switched off, only air of the ambient temperature flows through the chamber 24.

A switch 39 for push button activation of the heating element and an operating lamp 65 are provided on the casing 4 of the apparatus.

When forming a hair curl by means of the casing shown in FIG. 2 a relatively narrow bend is obtained. However, in the design described the casing 20 can easily be substituted by swinging out the flap 14 and extracting the casing from the groove 12 and from the endwall portions 40, 41 respectively, followed by the insertion of a new casing.

Figure 4:
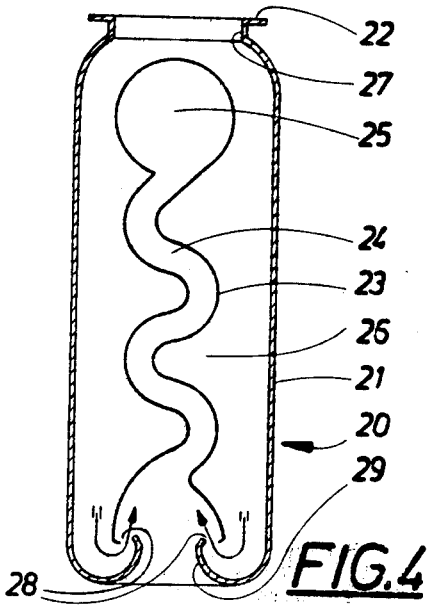
FIG. 4 is also a cross-sectional view corresponding to the cross-section of FIG. 2 and showing the forming chamber in its third variant.

Another design of a casing is shown in FIG. 3. Here the chamber 24 is of another form, which results in a curl on the end of a relatively long strand of hair, whereas the inner portion of the strand remains relatively straight. In the design of the chamber 24 illustrated in FIG. 4 a zigzag curvature of the hair strand is obtained. Because of the fact that the casing 20 is of symmetrical design, it can be turned, so that one can obtain the desired direction of curvature irrespective of the direction in which one wishes to hold the handle. If the hair shall be combed in connection with the operation, it can be made by means of the comb 18.

Figure 5:
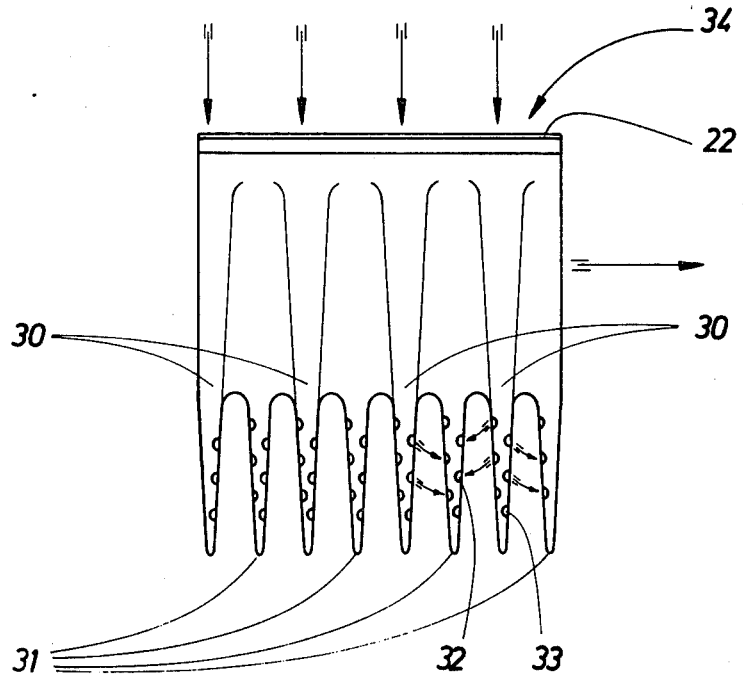
FIG. 5 is a side elevational view of a combing means, which forms an alternative to the forming chamber.

The comb 34 illustrated in FIG. 5 is intended for blow waving. Air can flow in through every second tooth from an opening corresponding to the opening 27 (FIG. 2). Said teeth are indicated with 30. The other teeth indicated with 31 are on the other hand in communication with holes in the end plates of the comb 34, which is intended to be between the front surface 28 and the flap 14 in the same manner as the casing 20. Air can be sucked from the surroundings into the duct 6 through one of these holes via the teeth 31 through holes 32 of said teeth. Also the teeth 30 have holes 33, and when the comb 34 is in position in the casing 4, said holes 33 will consequently be in communication with the chamber 8.

The embodiment now described is, thus, intended to be connected by means of a hose to a suction means. The apparatus according to this embodiment is in the first place intended for private use, and therefore more emphasis is laid on a simple design than on ergometrics, as the period of time during which an apparatus is in operation will be of relatively short duration. On the other hand, said second embodiment according to FIGS. 6–8 is intended for professional use, and in such connection the requirements are quite rigorous that the apparatus shall be as easy as possible to handle causing as little fatigue as possible in the person who shall operate the same, as the period of time it can be in operation can extend over whole working days.

Figure 6:
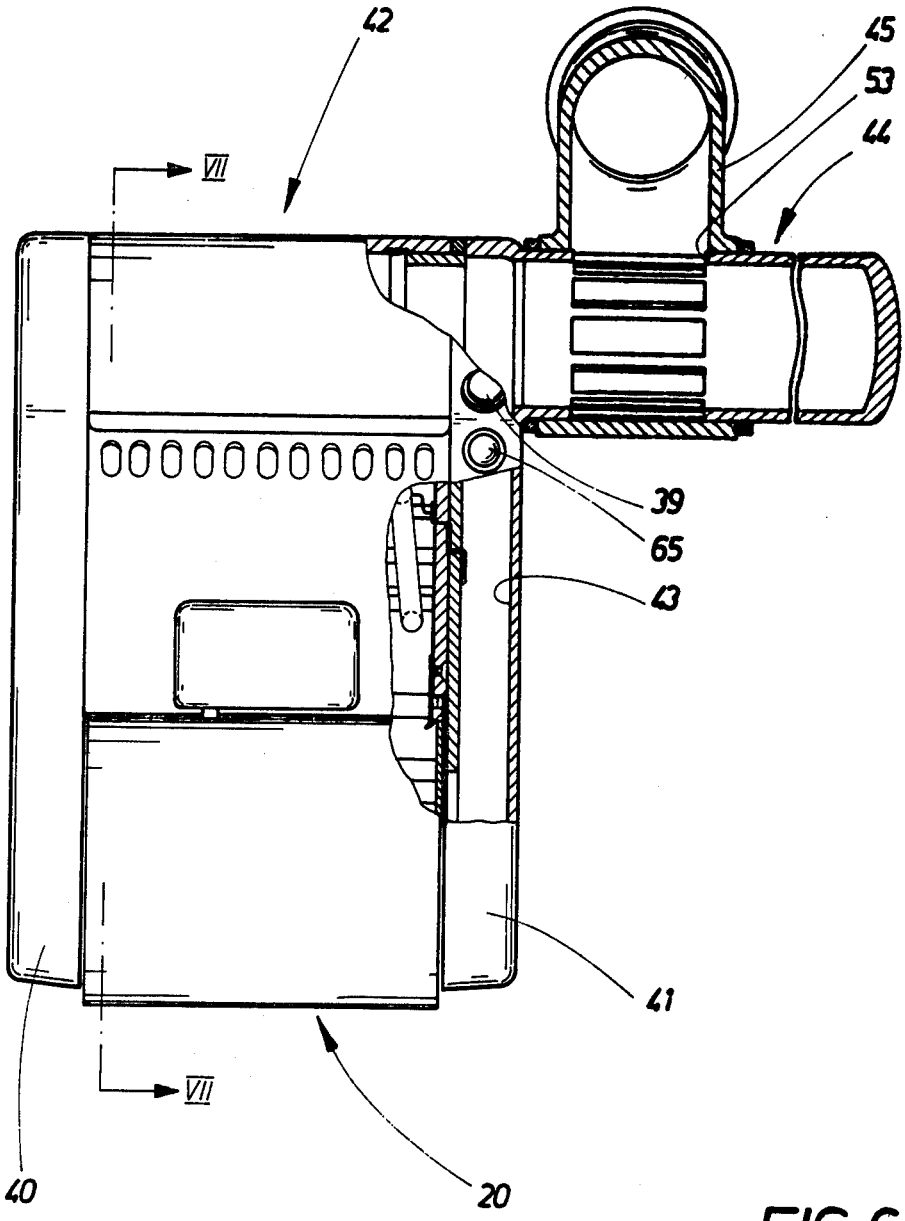
FIG. 6 is a partly broken side elevational view of the apparatus according to the second embodiment.
Figure 7:
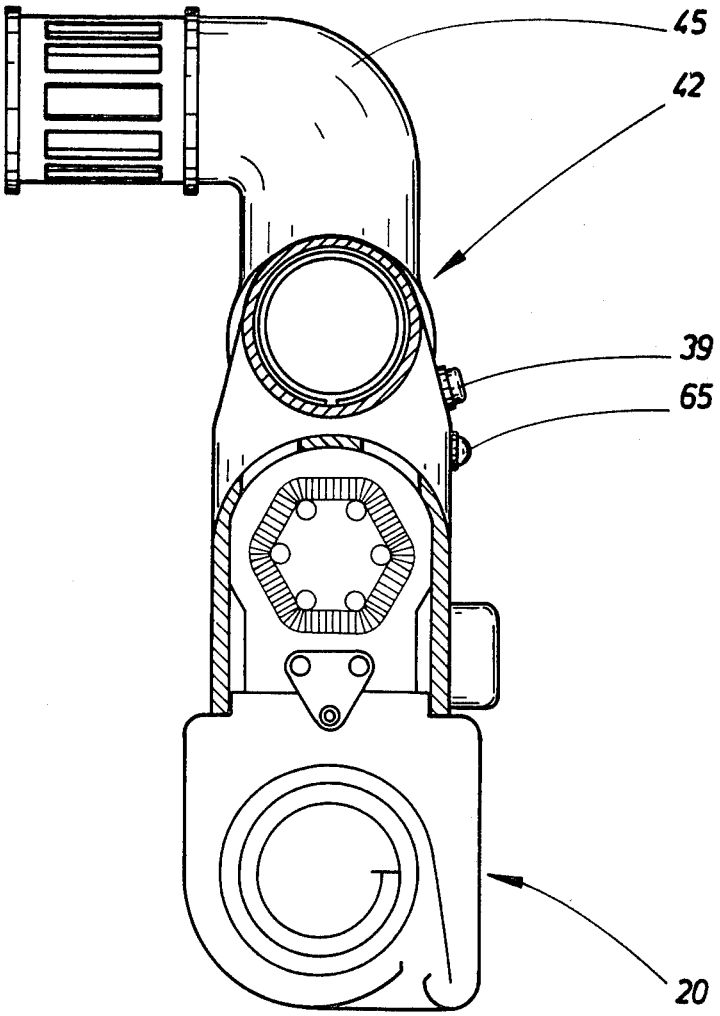
FIG. 7 is a cross-sectional view of the apparatus along the line VII—VII in FIG. 6.
Figure 8:
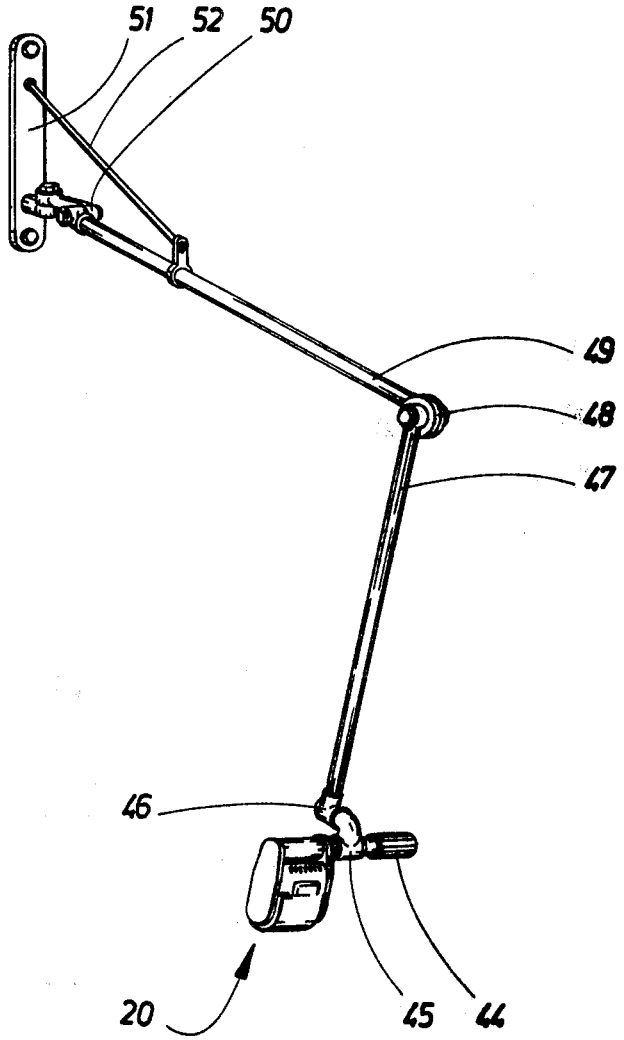
FIG. 8 is a perspective view on a reduced scale showing an installation with the apparatus according to FIGS. 6 and 7.

As is evident from FIGS. 6 and 7 the apparatus itself is of substantially the same design as the apparatus according to the first embodiment. However, the hair forming casing 20 (or possibly the comb 34) is placed between two end walls 40 and 41 of substantially identical shape. The end walls 40 and 41 hold between them the casing 20, and they are in turn held to a casing 42, which houses the details of the apparatus described, such as the heating element. The end wall 41 has a duct 43 for the exhaust of the air. The end wall 41 blends into a handle 44, which is shown in shortened condition in FIG. 6. A nipple housing 45 extends round the handle and can be pivoted round the same. Outside of the nipple housing 45 the handle 44 forms a grip. As is evident from FIG. 8 the nipple housing 45 with its outer end connects to an additional articulation 46, which forms a right angle to the articulation formed by the nipple housing 45 pivotable round the handle 44. The nipple housing 45 can moreover be pivoted relative to the articulation 46. The articulation 46 is in turn attached to a tube 47.

Thus, the apparatus can be pivoted in all directions relative to the tube 47. The tube 47 can moreover be pivoted in an additional articulation 48, by means of which the tube 47 is connected with a second tube 49. The tube 49 is in turn by means of a double articulation 50 connected to a wall bracket 51.

This means that the tubes 47 and 49 form an articulation system which is swingable in all directions, and which together with the possibilities to adjust the apparatus in all directions makes it possible to move the casing 20 with its entrance opening 29 into any desired position within a limited space. Thus, with a suitable mounting of the now described means above a hairdresser's chair one can obtain that the apparatus can be adjusted into any desired position relative to the head of somebody sitting in the chair to be treated. The apparatus and the articulation system are moreover balanced by means of a balance means 52, which is illustrated in the form of an arm, and which is assumed to be connected with a springing or weighting means. By this arrangement the person in charge of the apparatus can move the same into the positions necessary for the hairdressing work without any real load, and friction means are moreover introduced, so that the apparatus remains in the position in which it has been set. It is therefore not necessary to hold the apparatus during the very moment of treatment. It is convenient if two apparatuses of the kind shown in FIG. 8 are provided at each hairdresser's chair, so that one of the apparatuses can be moved into position for the treatment of a hair curl while the other apparatus is carrying out its cycle of treatment.

As mentioned above the articulation system described comprises the tubes 47 and 49 and through-flow nipples provided as articulations. By this arrangement a duct system is formed from the wall bracket 51 to the nipple housing 45. The nipple housing 45 by means of openings 53 is in turn in communication with the interior portion of the hair forming chambers of the casing. The communication duct is at the wall bracket 51 in communication with a suction device. By means of this suction device air can, according to the intended function, be sucked in through the entrance opening 29 of the casing 20 and the ducts 28 from the heating chamber in order to be led to the suction device via the duct mentioned and the wall bracket 51.

As has been mentioned the apparatus according to the first embodiment is provided with a switch 39 for the start of the heating of the heating element and an operating lamp 65. A corresponding switch and operating lamp, also indicated with 39 and 65 respectively, are provided on the apparatus according to the second embodiment.

Figure 9:
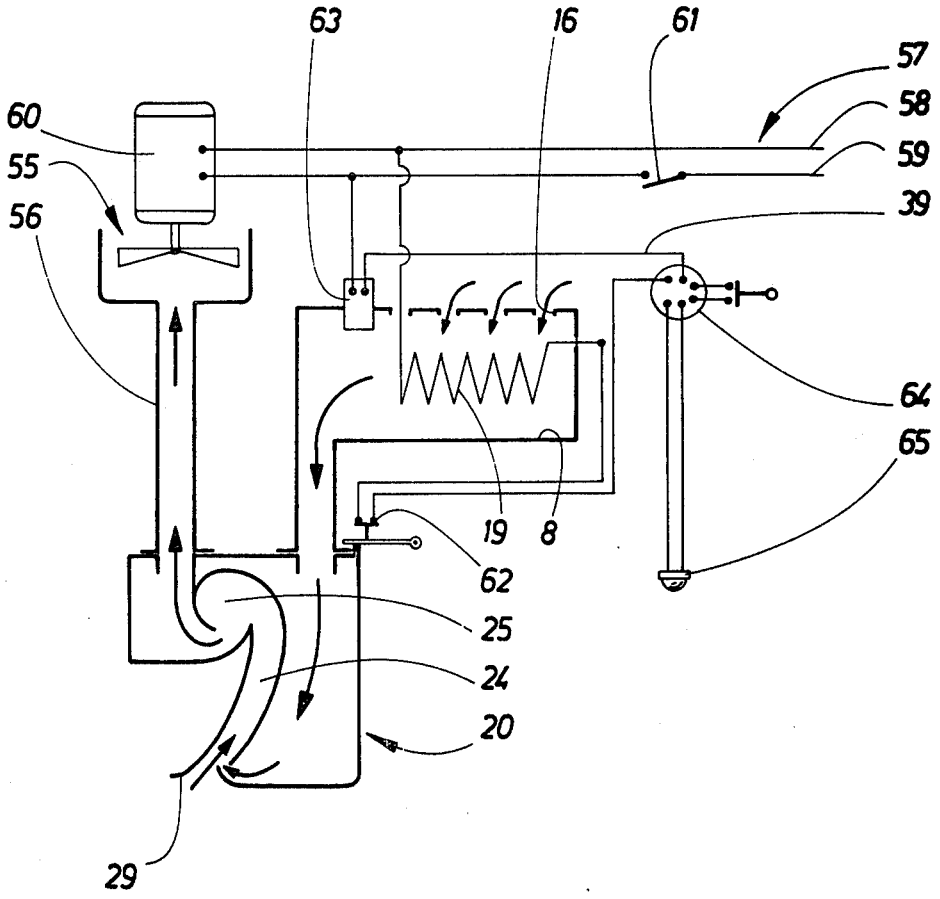
FIG. 9 shows an electric coupling diagram for the apparatus.

In FIG. 9 the apparatus is schematically illustrated in connection with an electric circuit diagram. As is evident from the figure, the casing 20 can be seen with its spiral chamber 24 and the inner chamber 25, which is in communication with said fan means, here indicated with 55. A conduit 56 extends from the casing 20 to the fan 55, said conduit being the hose connected to the socket 2 and the conduit illustrated in FIG. 8 respectively. Further evident from the figure, the communication of the chamber 8 with the entrance opening 29 of the casing 20, the electric heating element 19 placed in the chamber 8 as well as the openings 16 leading to the chamber 8.

A cable 57 from an electric power supply leads to the apparatus. It has in customary manner a zero conductor 58 and a phase conductor 59. Said conductors are connected with the two power-consuming units of the apparatus, viz. the electric motor 60 of the fan 55 and the electric heating element 19. A main switch 61 is provided for the connection and disconnection of said power consuming units. When this is switched on the fan 55 is operating, and an electric current is led to the controls of the heating element 19. Thus, the heating element 19 is not necessarily joined in the circuit by the very act of closing the main switch 61, but on the other hand it cannot be connected with the power supply, unless the main switch is closed.

The switch 39 is mounted on the very casing of the apparatus for the control of the operation of the heat element 19, when the main switch 61 is closed. However, a prerequisite condition for a switching in requires that besides the main switch 61 being closed also the casing 20 is in place in the apparatus, which means that a safety switch 62 is closed. It is moreover required that a thermostat switch 63 is closed, which is always the case, if the temperature in the chamber 8 has not exceeded a certain maximum value. It is assumed that this will occur only if some fault should arise in the apparatus, by way of example a breakdown of the circulation because of some defect in the fan 55 or as a consequence of blocked ducts.

Thus, if the circuit leading to the heating element 19 is closed for the rest, one can connect the heating element with the power supply by closing the switch 39. As is evident from the circuit diagram, however, the switch 39 does not work directly in the circuit leading to the heating element 19, but actuates a time switch 64. This means that when the switch 39 is actuated, the heating element 19 is connected to the circuit during a determined period of time, which can be set in advance. The circuit is thereafter disconnected and the heating element is not switched on until the switch 39 is again actuated. The time switch 39 is also arranged to activate the operating lamp 65, so that this lamp is turned on when the heating element is connected and during an adjustable second period of time after the heating element 19 has been disconnected. Thereafter the lamp is again switched off and is not turned on again until the heat again has been put on for the next heating period.

When a hair lock shall be formed, the apparatus is started by means of the main switch 61, and a strand of hair is brought to the entrance opening 29 and will thereby be pulled along by the inwards rushing air stream and be introduced into the chamber 24 so far as the free length of the hair strand permits. In then adapts its shape to the spiral shape of the chamber 24. The heating of the heating element 19 is now started by means of the switch 39. During its stay in the chamber 24 the hair strand is warmed by said heated air stream, so that the horny substance softens, and a plastic bend of the hair is obtained. As mentioned this effect can be increased if the hair is wet before it is introduced through the entrance of the chamber, or if it has been treated with special styling liquids, when a drying effect also is obtained.

However, a fixation of the hairlock formed is obtained only after the horny substance of the hair has resumed normal temperature. In order to obtain also a cooling off of the hairlock in the apparatus said time switch 64 is provided The first mentioned period of time, during which the heating element is connected to the circuit, is as a matter of fact adjusted in such a manner that the necessary softening of the horny substance is obtained. Thereafter the heat is cut off and only unheated air flows through the chamber causing the hair to be cooled off and the hairlock to be fixed. When the second adjusted period of time, which has been calculated for a suitable cooling off effect, has expired, the operating lamp is switched off, which indicates that the cycle of treatment can be interrupted by extraction of the curl of hair.

By means of the apparatus it is obtained that the hair is first formed by being pulled into the spiral shaped chamber, in which it is subjected to a heating process, whereafter, while still remaining in the chamber, its acquired shape is fixed by being cooled off. Thus the apparatus is arranged to perform the following cycle of treatment which at the same time is characteristic of the method according to the invention:

1. The strand of hair, which shall be subjected to treatment, is pulled into the forming chamber by air being sucked through the same from its outer entrance, whereby the hair adapts itself to the shape of the chamber.
2. The heating of the air sucked into the chamber is started, which can take place before or immediately after the introduction of the strand of hair.
3. The time switch means is started at the moment of introduction of the strand of hair.
4. After a suitable period of time adjusted to bring about the softening of the horny substance, the time switch cuts off the heating process, so that air which is not heated is pulled through the chamber, whereby the hair curl is cooled off and the horny substance is fixed in the shape acquired.
5. After a period of time adapted to the cooling off of the hair curl, the operating lamp is switch off by means of the time switch, which indicates that the hair curl is ready for extraction out of the chamber.
6. The hair curl is extracted out of the chamber in shaped and fixed condition.

The operating lamp and its function in connection with the cooling off of the hair lock can be dispensed with, if one prefers to rely upon the judgement regarding time of the person attending the apparatus.

It is suitable to design the apparatus in such a manner that the electric heating element is connected in the circuit only when the fan means is already connected. Such an arrangement is evident from FIG. 9. This is a precautionary step in order to impede overheating of the heating element, which can take place, if it is not passed by any air stream. It is also suitable that the accessories, the casing 20 and the comb 34 respectively described, are in connection with said switch 62, so that the heating element can be joined in in the circuit only when an accessory is mounted in the apparatus. By this arrangement it is avoided that the heating element is kept joined in, while the fan is operating without the communication between the intake duct and the heating element normally constituted by the chamber casing and the chamber respectively. As a matter of fact the air stream past the heating element will not be sufficient, if said communication is missing.

When using the blow waving comb 34, air will be sucked in through the holes 32, when the fan is started, and this will to a certain extent cause air to be exhausted through the holes 33. The air exhausted through the holes 33 must be taken from the surrounding air via the chamber 8 and the holes 16 and will, thus, be heated up by the heating element 19. Thus, a transversally directed heated air stream between the teeth is obtained and consequently a heating of the hair while it is being combed. By means of a suitably chosen combing technique one can dry the hair by means of the current of air, and the accessory lends itself also in other respects excellently for hair drying, as the hair is being disentangled at the same time as the hair drying operation is going on.

Also, other accessories in which the air is sucked in through the duct 6 and at least to some extent is taken from the chamber 8 can be imagined.

I claim:

1. Apparatus for forming hair, comprising: a hair forming tool provided with a casing having a first opening, at least one first duct in said casing and a first chamber communicating with said first duct, a suction device for creating an underpressure in said first duct and communicating with said first duct through said first chamber, said first opening serving for the introduction of a strand of hair into said first duct and into said first chamber, a second chamber surrounding said first chamber and forming part of at least one second duct communicating with ambient air, heating means in said second duct, said second duct having a second opening adjacent said first opening for passage of air from said heating means through said second duct into said first chamber, said second chamber via said second opening surrounding said first opening having a first connection with the first duct, and also having a second connection with the second duct for the supply of air, so that when there is an underpressure in said first duct, air rushes in via said first opening and via said first connection partly directly from the ambient air and partly from said second chamber and through said first duct to said first chamber, and timing means connected to said heating means for keeping the same in operation for a first predetermined period of time and for discontinuing operation for a second predetermined period of time, and also connected to said suction device for keeping the same in operation even when said heating means is inoperative.

2. An apparatus according to claim 1, comprising: indicator means connected to said timing means operative during said second period of time to indicate that said heating means is inoperative.

3. An apparatus according to claim 1, wherein said tool, including said first duct and said chamber are detachably connected to said apparatus.

4. An apparatus according to any one of the claims 1 to 3, wherein said tool together with said heating means forms a first unit, and said suction device forming a second unit, said second unit being provided as a fixed mounted unit and said tool together with said heating means forming a displaceable unit, which is in communication with said suction device by means of a movable conduit.

5. An apparatus according to claim 4, wherein said conduit is an articulated system which is arranged to support said first unit, the weight of said first unit substantially being balanced.

* * * * *